US005106359A

United States Patent [19]

Lott

[11] Patent Number: 5,106,359

[45] Date of Patent: Apr. 21, 1992

[54] CARTON FORMATION SYSTEM

[76] Inventor: Michael E. Lott, 1038 SE. Prineville Rd., Port St. Lucie, Fla. 34983

[21] Appl. No.: 760,500

[22] Filed: Sep. 16, 1991

[51] Int. Cl.[5] ..... B31B 3/80; B31B 5/78; B31B 3/62; B31B 5/36

[52] U.S. Cl. ..... 493/125; 493/131; 493/181; 493/182; 493/183; 493/316

[58] Field of Search ..... 493/123, 125, 126, 127, 493/131, 177, 178, 181, 182, 183, 316, 319

[56] References Cited

U.S. PATENT DOCUMENTS

| | | | |
|---|---|---|---|
| 3,476,023 | 11/1969 | Fuller et al. | 493/183 |
| 3,580,144 | 5/1971 | Renard | 493/183 |
| 3,690,224 | 9/1972 | Derderian et al. | 493/183 |
| 4,163,414 | 8/1979 | Bachman et al. | 493/183 |
| 4,275,644 | 6/1981 | Moss | 493/316 |
| 4,285,682 | 8/1981 | Moss | 493/316 |
| 4,414,789 | 11/1983 | Pattarozzi | 493/316 |
| 4,498,893 | 2/1985 | Odom | 493/316 |
| 4,579,551 | 4/1986 | Ulrich et al. | 493/316 |
| 4,857,038 | 8/1989 | Tacchini | 493/316 |

*Primary Examiner*—William E. Terrell
*Attorney, Agent, or Firm*—Carroll F. Palmer

[57] ABSTRACT

A method is disclosed for erecting flat carton blanks into a tubular configuration, folding the minor flaps inwardly normal to the minor sides in three steps at a first work station, moving the erected carton blank to a second work station while partially folding the major flaps toward the folded minor flaps and applying glue to the minor flaps, further moving the carton blank to a third work station where the major flaps are pressure sealed to minor flaps and then discharging the finished carton from the work area. A machine for performing the method includes unique motor driven chain drive assemblies that enable adjustments to accommodate various size carton and a cam regulated valve system to control application of vacuum to suction cups and compressed air to a glue gun and to pneumatic pistons that move control arms and the like.

8 Claims, 5 Drawing Sheets 4A
26
72
28
12A
30

4C
52
54
56
6B
6A
10A
42
10B 28
26
4
72
30

44
6A
40
46
4C
6B
90
10A
50
38
14
82
34
26
12B
10B
6B
8B
4A
6A
10A
32
8A
28
12A 14
4
16

36
28
10A
4B
14

CARTON FORMATION SYSTEM

BACKGROUND OF THE INVENTION

1. Field of the Invention

This application relates broadly to carton formation systems and methods. More particularly, it concerns machines and methods for setting up folded carton blanks and subsequently folding their minor and major flaps while gluing the major flaps to the minor flaps.

2. Description of the Prior Art

Foldable shipping cartons of the rectangular four-flap type are typically manufactured from a single piece of corrugated board or the like, cut into a predetermined pattern and provided with indented fold lines to enable the blank to be folded from a flat blank into a rectangular carton. The "knocked-down" flat carton blanks are shipped by the manufacturer to a user who must erect the blank by opening it into a tubular shape, fold the bottom flaps inwardly to a closed position and fasten them in the closed position e.g., by gluing, taping or stapling.

Numerous different types of machines have been developed for erecting carton blanks, then folding and fastening the flaps to form useable rectangular cartons. In some of such machines, the blanks are stacked in a vertical position for delivery into the machine, e.g., see U.S. Pat. Nos. 4,348,853; 4,579,551 and 4,892,513. In other machines, the blanks are stacked in a slanted position from which they are moved either from the top of the stack or from the bottom, e.g., see U.S. Pat. No. 4,331,435, into the machine. In still other machines, the blanks a stacked in a horizontal position from which they are moved either from the top of the stack, e.g., see U.S. Pat. No. 4,133,254, or from the bottom into the machine. The machines of the present invention are of the type in which the blanks are stacked in a horizontal position and are moved from the bottom of the stack into the machine.

OBJECTS

A principal object of the invention is the provision of new carton erection systems and methods.

Further objects include the provision of:

1. New machines for erecting flat carton blanks into a tubular form, folding their minor and major flaps and then gluing them together.

2. Such machines that use less moveable parts then prior known carton erection machines.

3. Such machines that are adjustable as to carton size and depth of flaps.

4. Such machines that are easy for operators to run.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of machines for setting up and sealing flat carton blanks having first and second major flaps foldably attached to respective first and second major carton sides and first and second minor flaps foldably attached to respective first and second minor carton sides.

The new machines comprise horizontal platform means for supporting carton blanks during the setting up and sealing and means to hold a stack of horizontal flat carton blanks and move the bottom blank from underneath the stack including adjustable catch dogs that push the bottom blank onto the platform means.

There is also suction means comprising a first suction cup for holding a carton blank on the platform means at a first work station and a second suction cup to grasp the first minor side of the carton blank and move it from a horizontal position to a vertical position thereby erecting the carton blank into a tubular configuration.

Also, there is first arm means to engage the first minor flap extending from the first minor side and fold it partially in toward the erected carton blank and second arm means to engage the second minor flap and fold it normal to the second minor side.

Further, the machine has moveable horizonal bar means to engage the first minor flap and move it normal to the first minor side and pusher means to move the erected carton blank over the platform from the first work station to second and third work stations comprising upper and lower pusher dogs carried on upper and lower endless chains that each run around respective upper and lower horizontally spaced upstream and downstream sprocket wheels.

There are drive means to operate the pusher means and motor means are provided to operate the drive means.

First and second plow bars are positioned at the second station to engage the first and second major flaps as the erected carton blank is moved from the first station to the second station thereby to bend the major flaps partially toward the folded in minor flaps. Also located at the second station is glue means that includes a glue head to apply glue to the minor flaps.

Ram means that is positioned at the third station to seal the major flaps to the minor flaps comprises a stationary backing plate and a horizontally movable ram plate.

The entire machine is operated by an electric motor that drives the various moving parts with continuous chains traveling over sprockets, some of which are moveable to enable the machine to set up and seal a variety of different size carton blanks. The motor also drives a battery of cams that function at required times to open and close valves that apply air pressure to pistons to move levers, etc. or suction to suction cups to hold the carton blanks or move parts of them.

BRIEF DESCRIPTION OF THE DRAWINGS

A more complete understanding of the invention can be obtained by reference to the accompanying drawings in which.

DESCRIPTION OF THE PREFERRED EMBODIMENTS

Figure 1:
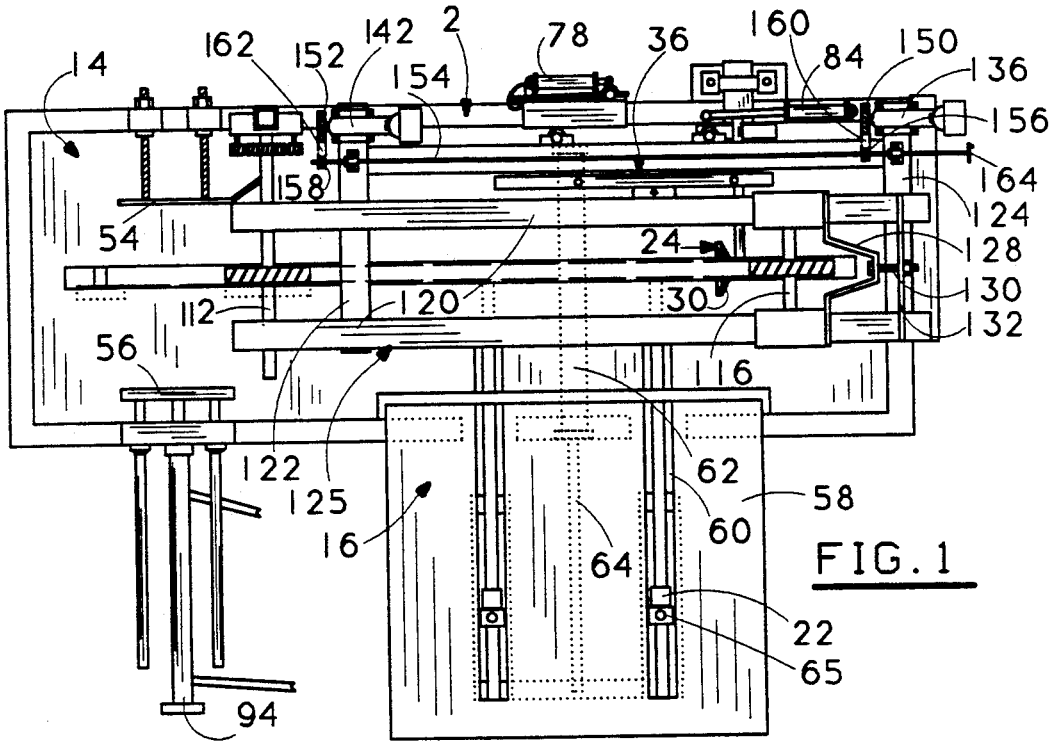
FIG. 1 is a plan view of a carton erection machine structured in accordance with the invention.
Figure 2:
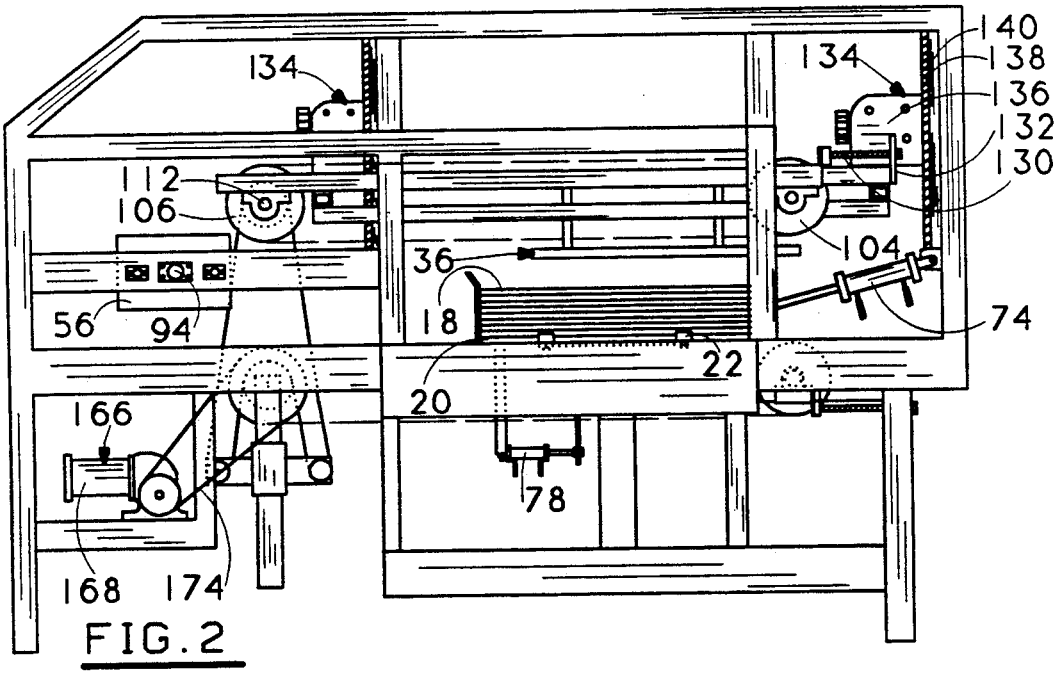
FIG. 2 is a front view of the machine of FIG. 1.
Figure 3:
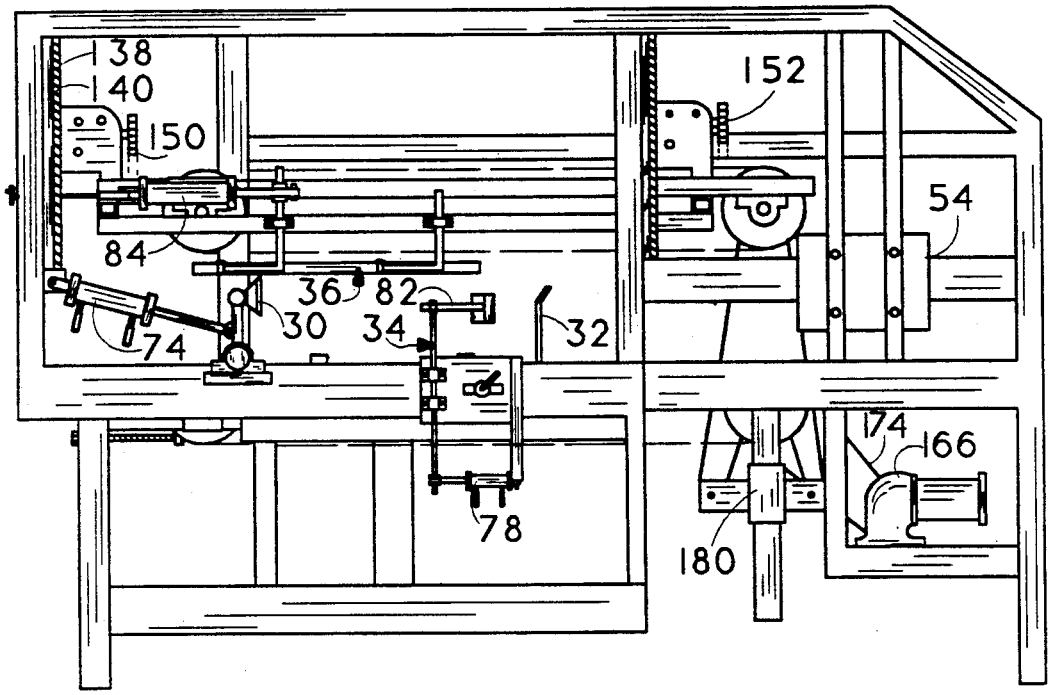
FIG. 3 is a rear view of the machine of FIG. 1.
Figure 4:
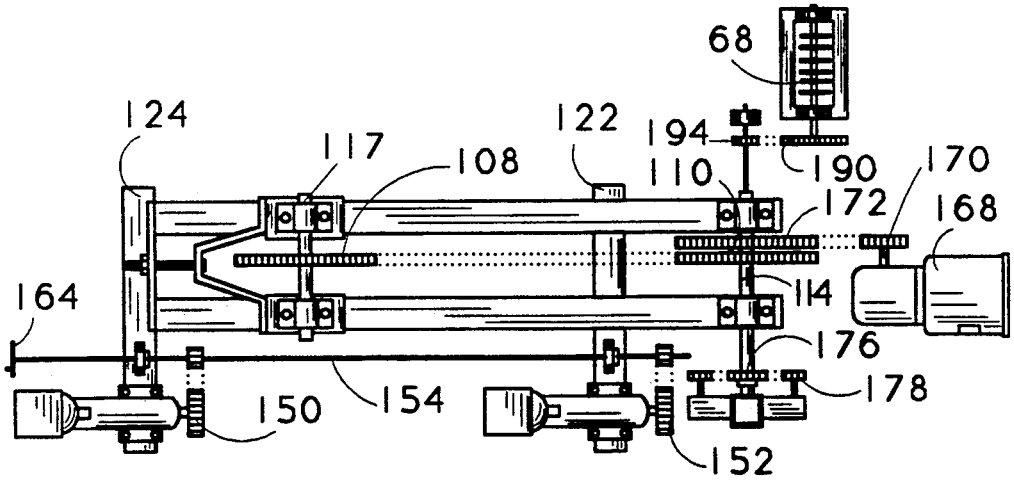
FIG. 4 is a plan view of a chain drive section of the machine of FIG. 1.
Figure 5:
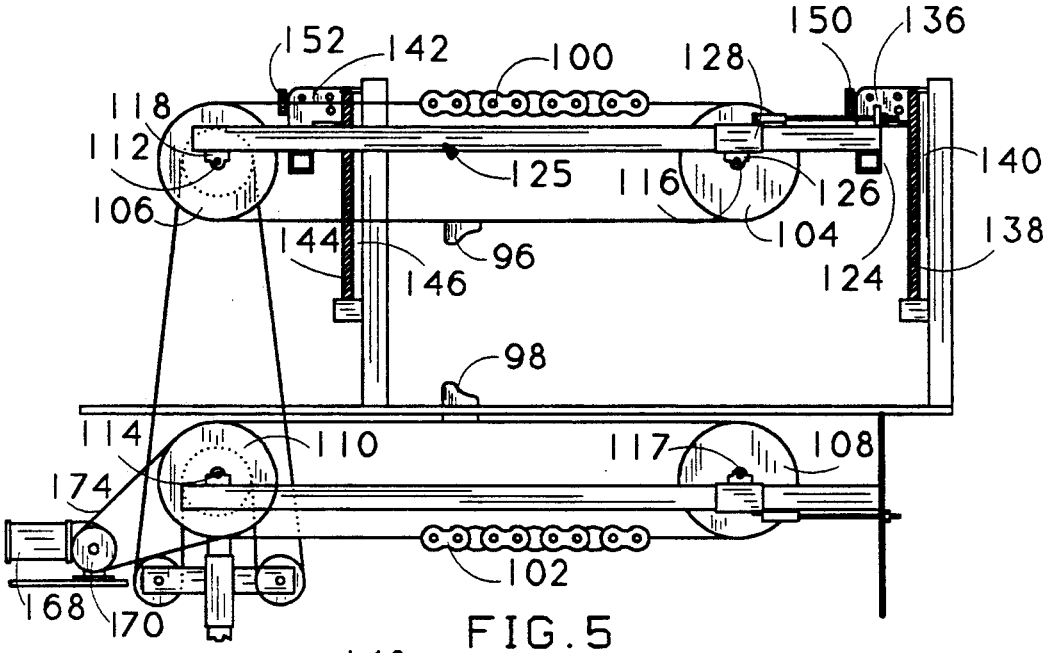
FIG. 5 is a lateral view of the machine section shown in FIG. 4.

Apparatus 2 of the invention is used to set up and seal folded carton blanks 4 having first and second major flaps 6A and 6B foldably attached to respective first and second major carton sides 8A and 8B and first and second minor flaps 10A and 10B foldably attached to respective first and second minor carton sides 12A and 12B.

With reference initially to FIGS. 8A–8G for a general understanding of the equipment of the invention and its operation, apparatus 2 comprises horizontal platform means 14 for supporting carton blanks during the setting up and sealing blanks 4, feeder means 16 to hold a stack 18 of folded carton blanks and move the bottom blank 20 from underneath the stack 18 including adjustable catch dogs 22 that push the bottom blank 20 onto the platform means 14.

Suction means 24 includes a first suction cup 26 for holding carton blank 4 on platform means 14 at a first work station 28 and a second suction cup 30 to grasp the first minor side 12A of carton blank 4 and move it from a horizontal position (FIG. 8B) to a vertical position (FIG. 8C) thereby erecting the carton blank into a tubular configuration 4A.

First arm means 32 engages the first minor flap 10A and folds it partially in toward the erected carton blank 4A, second arm means 34 engages second minor flap 10B to fold it normal to the second minor side 12B.

Moveable horizontal bar means 36 engages the first minor flap 10A to move it normal to the first minor side 12A.

Pusher means 38 moves the erected carton blank 4A over the platform means 14 from the first work station 28 to second work station 40 and third work station 42.

First and second plow bars 44 and 46 respectively positioned at the second station 40 engage the first and second major flaps as the erected carton blank 4A is moved from the first station 28 to the second station 40 thereby to bend the major flaps 6A and 6B partially toward the folded in minor flaps 10A and 10B.

Glue means 50 at the second station 40 applies glue to the minor flaps 10A and 10B as the blank 4A passes through second work station 40.

Ram means 52 positioned at the third station 42 to seal the major flaps 6A and 6B to the minor flaps 10A and 10B includes a stationary backing plate 54 and a horizontally movable ram plate 56.

Referring now to other FIGS. of the drawings, details of the machine 2 generically described above can be discussed.

The feeder means 16 comprises a table 58 with longitudinal slots 60 along which the catch dogs 22 are reciprocated by pneumatic cylinder 62 and piston rod 64 to move the bottom carton blank 20 from the bottom of stack 18 onto the platform 14 and into the first work station 28. The length of thrust of dogs 22 may be adjusted for different size carton blanks by use of set screws 65.

Figure 9:
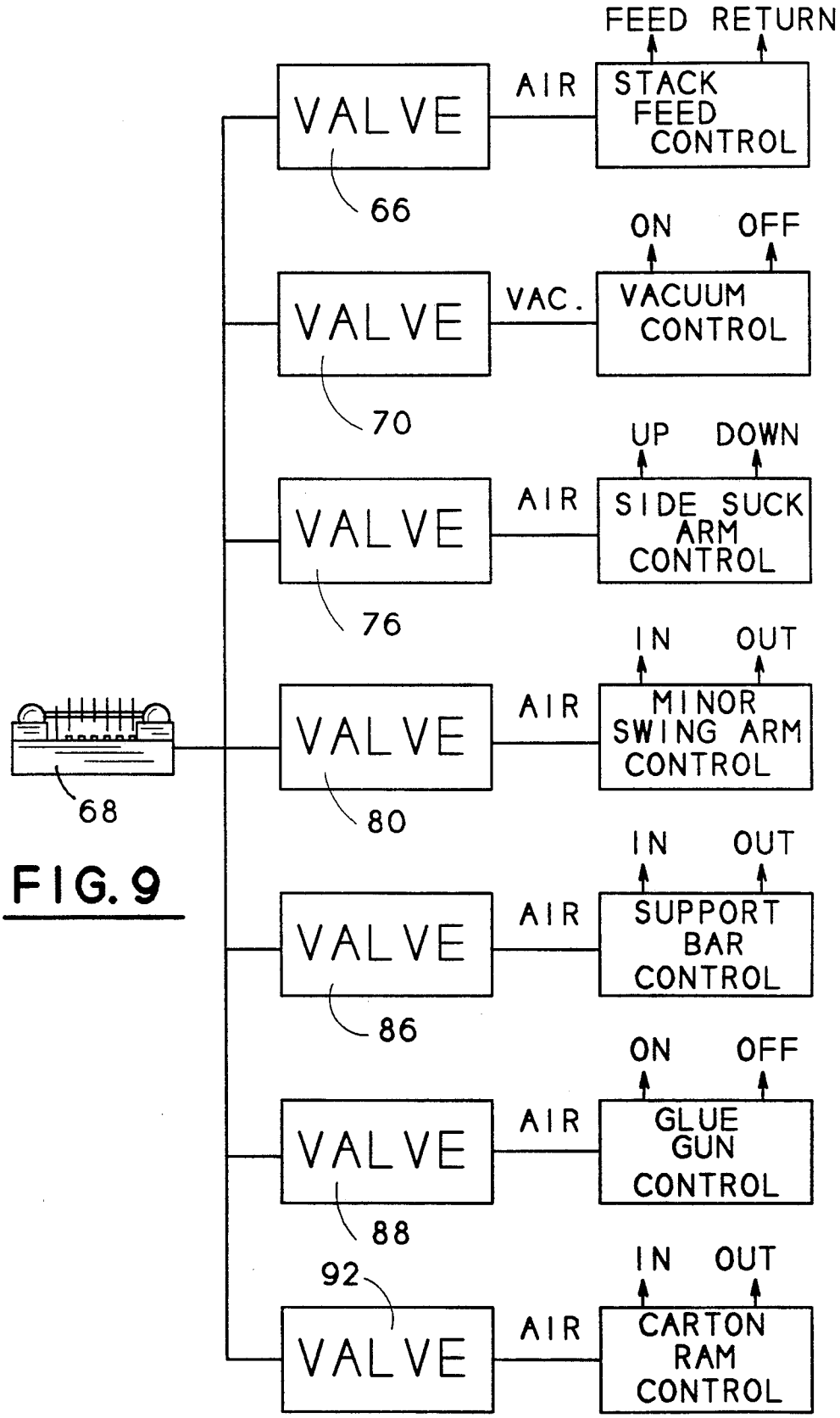
FIG. 9 is a schematic of the cam operated controls of the carton erection machine of the invention.

Operation of cylinder 62 is controlled by valve 66 and an associated cam of cam means 68. It is to be understood that cam means 68 also serves to actuate all the other valves shown in FIG. 9 whose functions will be explained below without further reference to cam means 68.

Figures 8A, 8B, 8C, 8D, 8E, 8F, 8G:
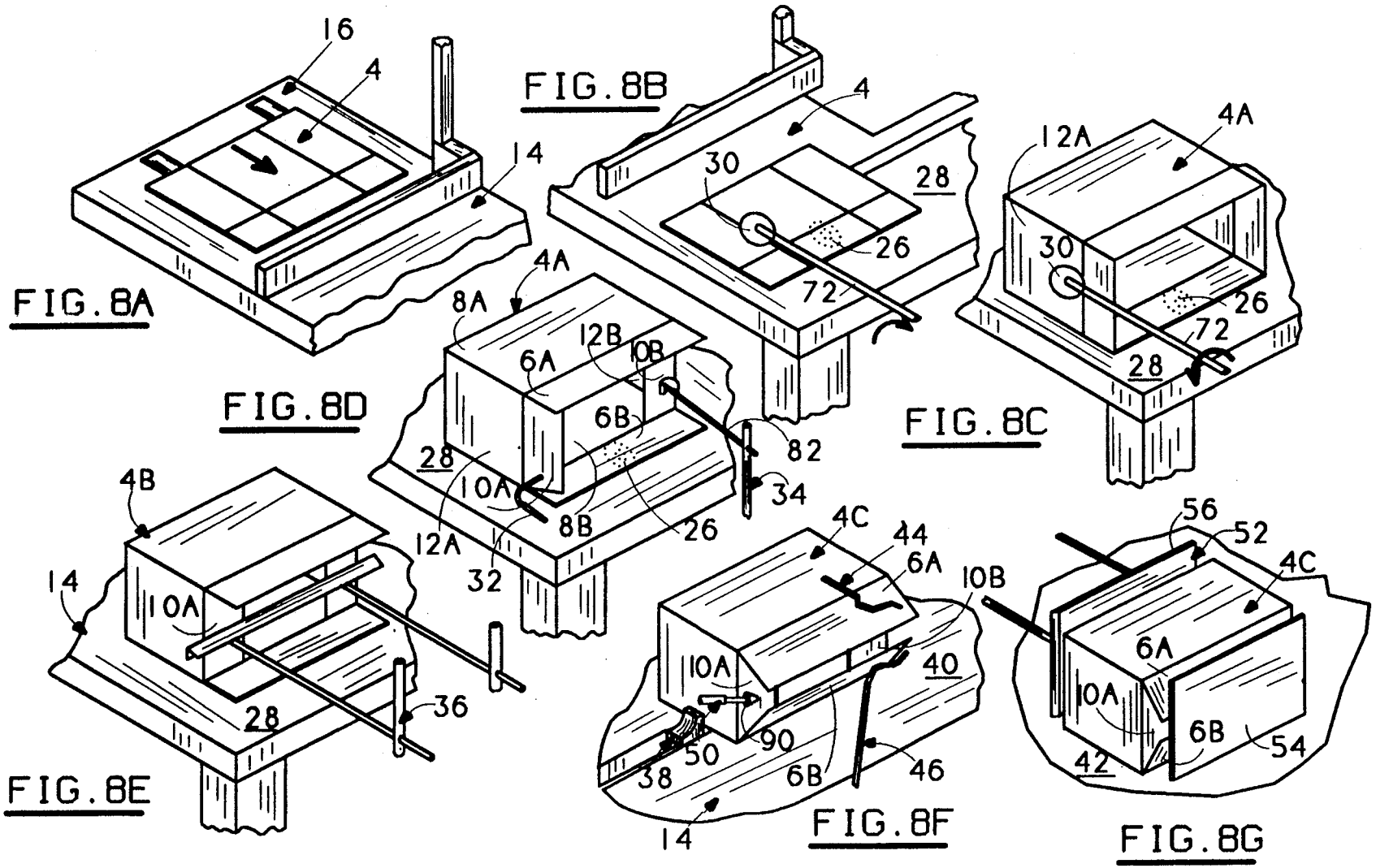
FIGS. 8A–8G are diagrammatic views of the sequence of steps involved in the erection of a folded carton in accordance with the methods of the invention.

When the flat carton blank 4 moves onto the work station 28, suction is applied via valve 70 to suction cup 26 to hold the major side 8B stationary and to suction cup 30 supported by arm 72 is moved by piston 74 operated by valve 76 in the direction shown by the arrow in FIG. 8B causing it to engage and grasp minor side 12A. With major side 8B held against the platform means 14, value 76 and piston 74 causes arm 72 to move in the direction of the arrow in FIG. 8C thereby erecting the carton blank into the tubular configuration 4A.

As blank 4 moves toward the configuration 4A, the minor flap 10A engages the first arm means 32 and is folded part way toward the minor side 12A. First arm means 32 is a stationary element, but its position can be adjusted vertically and/or horizontally to accommodate various sizes of blanks 4.

When the blank reaches the fully erect position 4A, piston 78 operated by valve 80 causes the arm 82 of second arm means 34 to swing toward the carton 4A to engage minor flap 10B and fold it normal to minor side 12B. Then, piston 78 withdraws arm 82 and piston 84 operated by valve 86 causes bar means 36 to move forward to push minor flap 10A in to fold it normal to its minor side 12A creating the carton configuration 4B.

As pusher means 38 moves the carton 4B from work station 28 to work station 40, major flap 6A engages plow bar 44 and major flap 6B engages plow bar 46 so both flaps are folded part way toward engagement with the fully folded minor flaps 10A and 10B creating the carton configuration 4C. At the same time, valve 88 causes glue means 50 to spray glue from spray head 90 onto minor flaps 10A and 10B as the carton 4C moves past spray head 90.

Next, carton 4C with glue on the minor flaps is moved from station 40 to third station 42 with all flaps facing the stationary backing plate 54. Here, valve 92 operates cylinder 94 to cause it to move ram plate 56 into the open end of carton 4C to force major flaps 6A and 6B against the minor flaps 10A and 10B thereby glueing all the flaps together and completing the construction of carton (not shown).

Finally, the finished carton is pushed off the platform means 14 onto a conveyor (not shown) or pickup by a worker (not shown) for on site packaging by the next carton that moves into the third station 42.

Returning to some details of machine 2, pusher means 38 comprises upper and lower pusher dogs 96 and 98 carried on upper and lower endless chains 100 and 102 that each run around respective upper upstream and downstream sprocket wheels 104 and 106 and lower upstream and downstream sprocket wheels 108 and 110. The upper and lower downstream sprocket wheels 106 and 110 are each fixed to driven horizontal downstream axles 112 and 114 and the upper and lower upstream sprocket wheels 104 and 108 are rotatably journalled on horizontal upstream idler axles 116 and 117.

Axle 112 rotates in bearings 118 that depend from longitudinal tubular bars 120 which are supported on transverse tubular bars 122 and 124 providing a frame unit 125. Axle 116 rotates in bearings 126 that depend from sleeves 128 slidably carried on tubular bars 120. Sleeves 128 are joined to yoke 128 that is adjustable held by bolt 130 to transverse bar 132 permitting tension on chain 100 to be adjusted by loosening or tightening the bolt 130.

The bearing support for lower axles 114 and 117 and tensioning arrangement for lower chain 102 generally mimic those disclosed above for upper axles 112 and 116 and chain 100, although the lower Axle bearings face upward rather than downward as with the upper Axle bearings.

Machine 2 includes Axle support means 134 that permits the vertical distance of axles 112 and 116 above platform means 14 to be adjusted. Means 134 comprises an upstream bracket member 136 that is vertically adjustable by means of threaded shaft 138 on an upstream vertical upright 140 and a downstream bracket member 142 that is vertically adjustable by means of threaded shaft 144 on a downstream vertical upright 146. Frame unit 125 is cantilevered from brackets 136 and 142.

Gear means 148 intermezzos with threaded shafts 138 and 144 whereby rotation of gear means 148 produces vertical movement of bracket members 136 and 142.

Gear means 148 comprises an upstream first sprocket wheel 150 carried by bracket member 136, a downstream first sprocket wheel 152 carried by bracket member 142, an elongated rod 154 carried on frame unit 125, an upstream second sprocket wheel 156 carried by rod 154, a downstream second sprocket wheel 158 carried by rod 154, an upstream endless chain 160 that runs around sprocket wheels 150 and 156, a downstream endless chain 162 that runs around sprocket wheels 152 and 158 and handle means 164 on the end of the rod 154 whereby rod 154 may be rotated to vertically adjust the distance of bracket members 136 and 142 above platform means 14.

Drive means 166 to operate pusher means 38 comprises, in part, a motor 168, a pair of sprocket wheels 170 and 172 and a continuous chain 174 that runs over such sprocket wheels. Means 166 also comprises sprocket wheel 176, a matched pair of sprocket wheels 178 supported on slide member 180 moveably carried on upright 182, sprocket wheel 184 keyed to axle 112, continuous chain 186 that runs around all wheels 176, 178 and 184, and adjustable spring unit 188 to bias slide member away from wheels 176 and 184.

Figure 6:
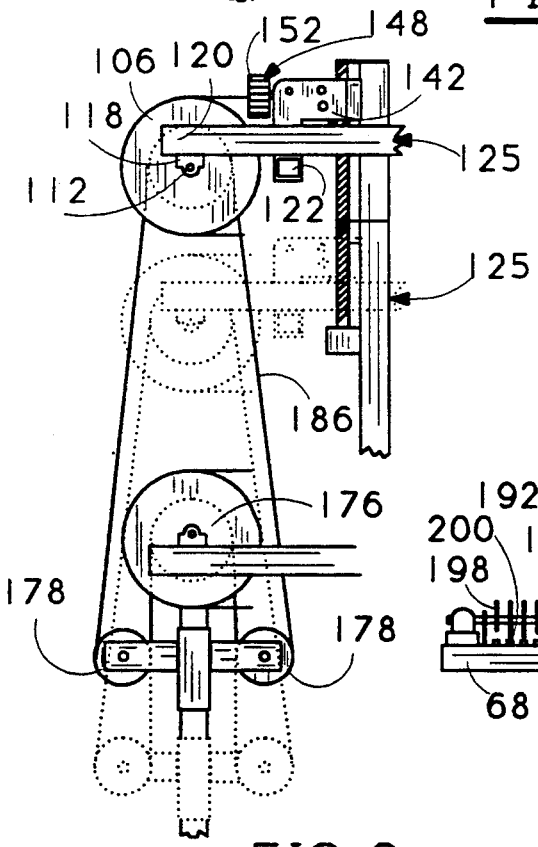
FIG. 6 is lateral view of a vertical chain slide adjustment section of the machine of FIG. 1.
Figure 7:
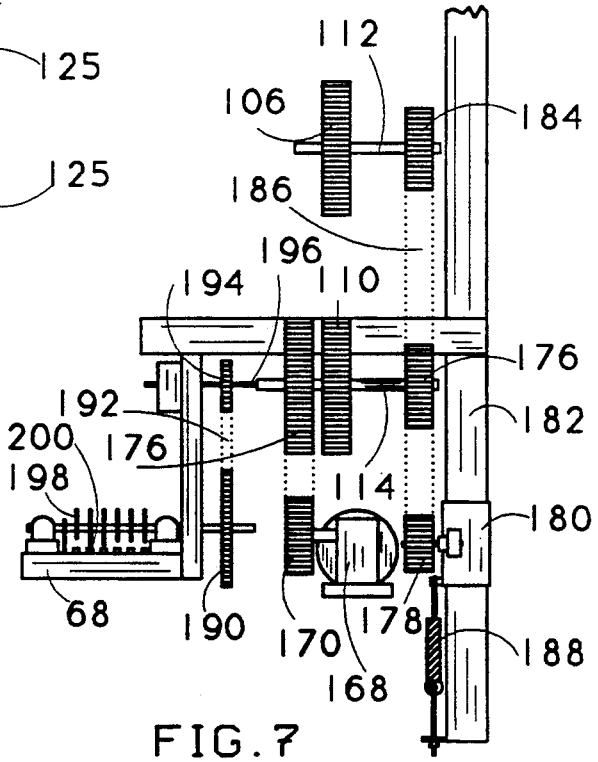
FIG. 7 is an end view of the machine section shown in FIG. 4.

Sprocket wheels 172 and 176 are keyed to axle 114 and sprocket wheel 184 is keyed to axle 112. Hence, rotation of sprocket wheel 170 by motor 168 serves to drive sprocket wheels 106 and 110 and in turn the chains 100 and 102 that drive pusher dogs 96 and 98. When the height of frame means 125 is readjusted by gear means 148, the idler sprockets 178 and slide member 180 serve to take up slack formed in the chain 186 (see FIG. 6).

Cam means 68 is operated by the motor 168 via sprocket wheel 190, chain 192 and sprocket wheel 194 whose shaft 196 is fixed to and rotates with Axle 114. Rotation of cam means by sprocket wheel 190 brings its cams 198 in proper timed sequence into contact with valve stems 200 so that valves 66, 70, 76, 80, 88 and 92 are opened and closed about the proper times to perform the functions previously described.

For the sake of clarity in the drawings, an air compressor and a vacuum pump as well as tubing connecting them to valves and pistons as shown and described have not been illustrated since these items are of conventional design and their location on or about the machine 2 is not critical to the invention and its understanding by those skilled in the art.

I claim:

1. A machine for erecting flat carton blanks having first and second major flaps foldably attached to respective first and second major carton sides and first and second minor flaps foldably attached to respective first and second minor carton sides into a tubular configuration, folding said flaps inwardly and sealing said major flaps to said minor flaps that comprises:

horizontal platform means for supporting said carton blanks during said erecting and sealing, means to hold a stack of said flat carton blanks and move the bottom blank from underneath said stack including adjustable catch dogs that push said bottom blank onto said platform means, suction means comprising a first suction cup for holding a carton blank on said platform means at a first work station and a second suction cup to grasp said first minor side of said carton blank and move it from a horizontal position to a vertical position thereby erecting said carton blank into a tubular configuration, first arm means to engage said first minor flap extending from said first minor side and fold it partially in toward said erected carton blank, second arm means to engage said second minor flap and fold it normal to said second minor side, moveable horizontal bar means to engage said first minor flap and move it normal to said first minor side, pusher means to move said erected carton blank over said platform from said first work station to second and third work stations comprising upper and lower pusher dogs carried on upper and lower endless chains that each run around respective upper and lower horizontally spaced upstream and downstream sprocket wheels, drive means to operate said pusher means, third and fourth arm means positioned at said second station to engage said first and second major flaps as said erected carton blank is moved from said first station to said second station thereby to bend said major flaps partially toward said folded in minor flaps, glue means at said second station including a glue head to apply glue to said minor flaps as said erected carton blank moves through said second station, ram means positioned at said third station to seal said major flaps to said minor flaps comprising a stationary backing plate and a horizontally movable ram plate.

2. The machine of claim 1 wherein said upper and lower downstream sprocket wheels are each fixed to driven upper and lower horizontal downstream axles and said upper and lower upstream sprocket wheels are rotatably journalled on horizontal upstream idler axles.

3. The machine of claim 2 wherein said upper upstream and said upper downstream axles are mounted on Axle support means whose vertical distance above said platform means is adjustable.

4. The machine of claim 3 wherein said Axle support means comprises a frame unit cantilevered on a upstream bracket member vertically adjustable on an upstream vertical upright and a downstream bracket member vertically adjustable on a downstream vertical upright.

5. The machine of claim 4 wherein said bracket members comprise vertical threaded shafts and gear means interested with said threaded shafts whereby rotation of said gear means produces vertical movement of said bracket members.

6. The machine of claim 5 wherein said gear means comprises an upstream first sprocket wheel carried by said upstream bracket member, a downstream first sprocket wheel carried by said downstream bracket member, an elongated rod carried on said frame unit, an upstream second sprocket wheel carried by said rod, a downstream second sprocket wheel carried by said rod, an upstream endless chain that runs around said first and second upstream sprocket wheels, a downstream endless chain that runs around said first and second downstream sprocket wheels and handle means on the end of said rod whereby said rod may be rotated to vertically adjust the distance of said upstream and downstream bracket members above said platform means.

7. The machine of claim 1 wherein said drive means comprises a motor, a lower sprocket wheel, an upper sprocket wheel and a continuous chain that runs over said sprocket wheels, said upper sprocket wheel being keyed to said lower downstream Axle.

8. The machine of claim 7 wherein said drive means further comprises another sprocket wheel keyed to said lower downstream Axle, a matched pair of idler sprocket wheels supported on a slide member moveably carried on an upright, further sprocket wheel keyed to said upper downstream Axle, a continuous chain that runs around all said another, said match pair and said further sprocket wheels, and an adjustable spring unit to bias said slide member away from said another and said further sprocket wheels.

* * * * *